United States Patent [19]

Bryant

[11] 4,294,221

[45] Oct. 13, 1981

[54] DEVICE FOR RETAINING A COMPOUND BOW IN A PARTIALLY DRAWN CONDITION

[76] Inventor: LeRoy J. Bryant, 2704 SE. 170th Ave., Portland, Oreg. 97236

[21] Appl. No.: 15,062

[22] Filed: May 3, 1979

[51] Int. Cl.[3] ..... F41B 5/00

[52] U.S. Cl. ..... 124/23 R; 124/DIG. 1

[58] Field of Search ..... 124/86, 24R, 90, 1, 124/80, DIG. 1; 74/422; 242/90, 107.6

[56] References Cited

U.S. PATENT DOCUMENTS

| | | | |
|---|---|---|---|
| 261,610 | 7/1882 | Howe | 124/23 R |
| 4,054,118 | 10/1977 | McKee et al. | 124/23 R |
| 4,178,905 | 12/1979 | Groner | 124/23 R |
| 4,187,826 | 2/1980 | Killian | 124/24 R |

*Primary Examiner*—Richard C. Pinkham
*Assistant Examiner*—William R. Browne
*Attorney, Agent, or Firm*—Chernoff & Vilhauer

[57] ABSTRACT

A compound bow with a retention device to hold the bow in a partially drawn position permitting the user to relax tension on the bowstring and remain motionless while hunting or to replace the bowstring. The retention device includes a ratchet or similar unidirectional device allowing rotation of an eccentric wheel in only one direction until it has rotated through a predetermined angle, and thereafter a release device releases the retention device to allow free rotation of the eccentric wheel. A lock is provided to selectively prevent rotation of the eccentric wheel.

11 Claims, 4 Drawing Figures

DEVICE FOR RETAINING A COMPOUND BOW IN A PARTIALLY DRAWN CONDITION

BACKGROUND OF THE INVENTION

This invention relates to archery bows, and particularly to compound bows.

A major advance in archery bows is the compound bow, disclosed in Allen U.S. Pat. No. 3,486,495. The compound bow, comprising a system of metal cables and eccentric wheels attached to the limbs of the bow, makes it possible to store a greater amount of energy in the drawn bow than is possible in conventional bows requiring the same maximum pulling force to reach the fully drawn position, yet requires less pulling force to hold the bow in the fully drawn condition. Because the pulling force required at the fully drawn position is less than the maximum pull weight, a lighter, more flexible arrow may be used with a compound bow than with a conventional bow having the same pull weight. The compound bow, therefore, provides higher arrow initial velocity and a flatter trajectory over a given range, allowing greater accuracy.

The sport of hunting game with bows of all types requires great stealth and skill in order to approach the quarry within the short range capability of the weapon, draw the bow, and aim shoot an arrow before the bird or animal is aware of the bowhunter's presence. Any movement by the bowhunter must be slow and deliberate, in order not to attract the attention of the quarry. Once within range, the hunter nocks an arrow on the bowstring and draws his bow, preferably while his quarry has not yet noticed him. If the animal notices the hunter, the hunter must instantly choose between continuing to full draw and releasing the arrow, thus making a hasty shot, and attempting to remain motionless with the bow at partial draw. The great difficulty with the latter alternative is that the hunter's arm and shoulder muscles quickly begin to fatigue and tremble while opposing the force of the partially drawn bow, causing both an unsteady aim and movement that is likely to be noticed by the animal.

This problem is more exaggerated in a compound bow than in a conventional bow. As the compound bow is drawn, the eccentric wheels are rotated by the cables, causing the force required to draw the bow to rapidly increase during the early stage of drawing the bow, reaching a point of peak pull somewhat short of the fully drawn position of the bow. As the bow is drawn further, to the fully drawn position, the pulling force required thereafter gradually decreases. In contrast, the pull of a conventional bow increases nearly linearly with the distance through which the bow has been drawn. As a result, except within a small final portion of the draw distance, the user of a compound bow, in holding his bow in a partially drawn position, must oppose a force which is greater than that of a conventional bow of similar pull weight. Even further exaggerating this problem, the reduced pull force of a fully drawn compound bow allows accurate use of a compound bow whose peak pull is greater than the maximum pull of the strongest conventional bow which a given person could accurately use.

One attempted solution to this problem is the bowstring release device disclosed in Barrick U.S. Pat. No. 4,041,925, which holds the bow in a fully drawn condition. The Barrick device, however, is incapable of holding the bow partially drawn and allowing continuation toward a full draw. Additionally, use of such a device is illegal in many states. Such devices also have the drawbacks of being too cumbersome for use in hunting and of tending to interfere with the cables of compound bows.

So as to avoid having to nock an arrow on the somewhat hard and inelastic cable which passes around the eccentric wheels, most compound bows include a bowstring of softer material, fastened usually by hooks to two separate lengths of cable which pass around the respective eccentric wheels. Because of the mechanical advantage provided by the cable and eccentric wheel arrangement, the limbs of a compound bow are very stiff, making it very difficult to flex the bow to replace such a bowstring. Restringing a compound bow may also require the use of special tools and a series of adjustments to return the bow to its properly tuned shooting condition. While some compound bows are equipped with a double set of bowstring attachment points on the cables, allowing installation of a new bowstring while the old bowstring remains attached, even this arrangement requires some outside means of maintaining tension on the old bowstring while installing a new bowstring on the second pair of attachment points.

Since shooting accuracy depends on skillful familiarity with the characteristics of the particular bow in its properly adjusted condition, for best hunting accuracy it is preferable to leave a compound bow strung and adjusted during travel to a hunting locality. Some states, however, prohibit transportation of a bow which is ready to shoot. A device is needed, therefore, which can disable a compound bow without removal of the bowstring, to allow its transportation without need for extensive adjustment prior to use.

What is needed, therefore, is a device capable of allowing a bowhunter using a compound bow to relax his tension on the bowstring while the bow is partially drawn without making a movement which is likely to be noticed by the game, which will facilitate replacement of the bowstring, and which is capable of disabling the bow without removal of the bowstring.

SUMMARY OF THE INVENTION

It is a major objective of the present invention, therefore, to provide a means for holding a compound bow in a partially drawn condition while hunting game, so that a bowhunter may make a more deliberate first shot and, therefore, have a greater chance of achieving a clean kill.

Another important objective of the present invention is to provide a device which holds a compound bow in a partially drawn position and yet automatically releases as the bow approaches the fully drawn position, allowing an arrow to be shot from the bow.

Still another objective of the present invention is to provide a device which enhances restringing of a compound bow without the use of auxiliary tools and without the necessity to retune the bow after its restringing.

A further objective of the present invention is to provide a device which will disable a compound bow for transportation while maintaining it in a strung condition.

According to the present invention an automatically releasing device is provided for holding a compound bow in a partially drawn condition enabling a bowhunter to remain practically motionless over extended periods of time with his compound bow at or near full draw. A ratchet or similarly effective unidirectional motion-limiting and retention device holds each of the eccentric wheels of the compound bow near its point of furthest rotation if the bowstring is relaxed while the bow is partially drawn, so that the cables attached to the eccentric wheels and the opposite limbs of the bow will hold the bow in a partially drawn condition if the hunter releases his pull on the bowstring before the bow has been drawn beyond a predetermined point. If necessary, the device of the invention can repeatedly hold the bow in a partially drawn position close to the furthest point to which the bow has been drawn, allowing the bowhunter to increase his draw by gradual increments to a point near the full draw of the bow. Once the bow has been drawn past a predetermined point, however, the unidirectional motion-limiting device is automatically disengaged, allowing the bow to function in its normal manner.

In a preferred embodiment of the invention, each eccentric wheel is fixedly attached to its shaft, and the shaft is rotatably mounted with respect to the limb of the bow generally perpendicular to the plane in which the limb flexes. A ratchet wheel attached to one end of the eccentric shaft is used to limit rotation of the eccentric wheel to a single direction relative to a respective limb of the bow during initial rotation through a predetermined arc. Once the eccentric wheel has rotated beyond that predetermined arc, the ratchet mechanism is disengaged to allow free rotation of the eccentric wheel in either direction.

In the device of the present invention, each cable is preferably fixedly attached to the respective eccentric wheel, since tension in the cable leading from each eccentric wheel to the opposite limb maintains the flexed condition of the compound bow when the bowhunter relaxes his pull on the bowstring. Ratchet teeth and a pawl are effective throughout a predetermined arc of rotation of the eccentric wheels to prevent more than a slight rotation of each eccentric wheel in the direction opposite to that in which it turns while the bow is drawn, until the bow is drawn slightly beyond the point at which its pull peaks at maximum value and begins to decrease. The ratchet is thereupon disabled by a cam, formed preferably as part of the ratchet wheel, which lifts the pawl clear of the ratchet teeth to a position in which a latch engages a catch on the pawl, to hold the pawl clear of the ratchet wheel and thereafter allow free rotation of the eccentric wheel.

With one of the devices of the invention attached to each limb of his compound bow, a hunter is enabled to nock an arrow on the bowstring and slowly draw the bow toward its fully drawn condition while his quarry is looking away. If the animal turns his attention in the direction of the bowhunter while the bow is partially drawn, the hunter may relax the bowstring slightly, allowing the force of the energy stored in the flexed limbs of the bow to be retained by the action of the automatic ratchet device of the invention, while the hunter merely supports the weight of the bow. When the animal again looks away, the hunter may continue the process of bringing the bow to its fully drawn condition, stopping again if the animal again looks toward the hunter. The several teeth of the ratchet will enable the hunter to stop at a number of separate positions between the bow's normal at rest configuration and the fully drawn condition. As the bow approaches the fully drawn condition, the ratchet automatically disengages, allowing release of the arrow. Once the first arrow has been shot the ratchet device remains disabled until the pawl latch has been released to allow the pawl to reengage the ratchet wheel, thus allowing the bow to be used, if necessary, in the ordinary fashion for successive shots in which stealth and slow motion are no longer a factor. When it is desired to once again use the ratchet mechanism, the pawl may be released by any suitable mechanism so that it again engages the ratchet wheel teeth.

When the pawl is engaged with one of the ratchet teeth, the pawl may be locked against the ratchet wheel by suitable means, thus preventing the eccentric wheel from turning relative to the limb of the bow and removing the mechanical advantage ordinarily provided by the cables. This greatly increases the effort required to bend the bow, making it practically impossible to bend a compound bow of normal hunting stiffness to effectively shoot an arrow. When thus locked the ratchet device of the invention provides an additional safety factor in that the cables restrain the limbs of the bow so that, in the event of bowstring failure, the bow may not dangerously spring to a straighter position.

The device of the invention can also be used to facilitate replacement of the bowstring. After partially drawing the bow and allowing the automatic ratchet devices of the invention to hold the bow in a flexed position, the bowstring may be sufficiently slackened to allow its replacement. The bowhunter is thus relieved of the necessity of carrying special tools or having assistance in replacing a bowstring, and since the adjustment of the bow is not altered during the replacement of the bowstring with one of equal length, the tuning of the bow is not affected.

The foregoing objectives, features and advantages of the present invention will be more readily understood upon consideration of the following detailed description of the invention taken in conjunction with the accompanying drawings.

DETAILED DESCRIPTION OF THE INVENTION

Figure 1:
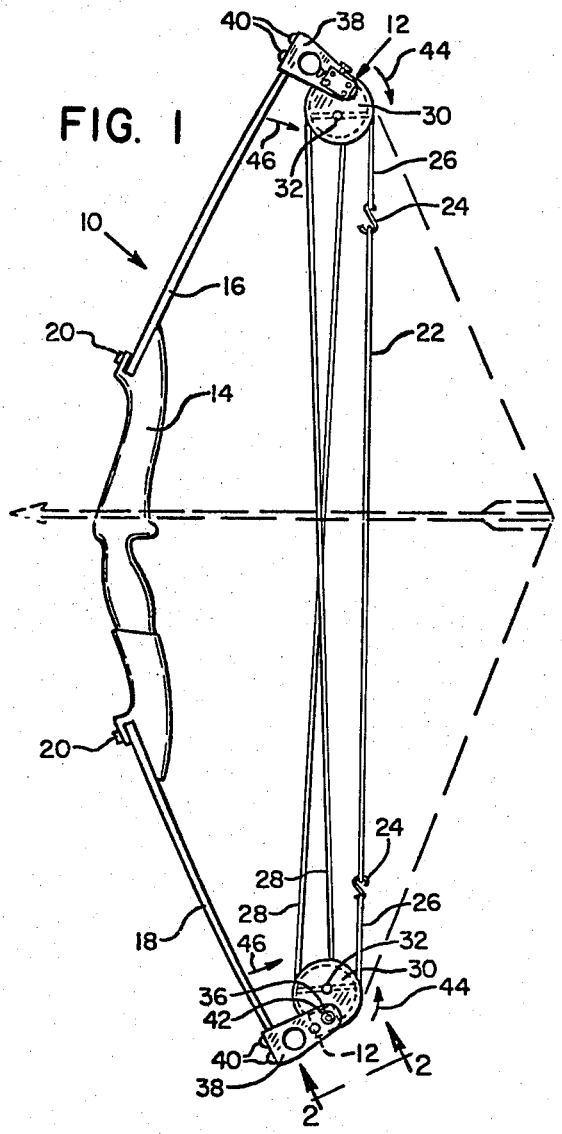
FIG. 1 is side view of a typical compound bow on which are mounted a pair of exemplary devices embodying the invention.

Referring now to the drawings, FIG. 1 shows a compound bow 10 on which are mounted a pair of devices 12 embodying the present invention. The bow 10 comprises a handle 14, an upper limb 16, and a lower limb 18. The limbs are adjustably attached to the handle by means of adjustment screws 20, which allow a slight variation in the angle of attachment of each limb to the handle, so that each limb may provide an equal amount of energy when an arrow is shot.

The compound bow has a short bowstring 22 of a flexible fiber cord material attached by hooks 24, for example, to one end of each of a pair of cables 26. Each cable is wrapped approximately one and one half turns around an eccentric wheel 30, to which it is fixedly attached, for example by extending through the eccentric wheel and being held in place by a set screw 32, and the other end 28 of each cable is fixedly attached to a portion of the bow, such as by being attached by a loop 34 fitted around an eccentric wheel shaft 36 attached to the opposite limb of the bow.

In an exemplary bow utilizing a pair of devices 12 embodying the invention, each eccentric wheel 30 is fixedly attached to an eccentric shaft 36 which is supported by a bracket 38 fixedly attached to the respective upper limb 16 or lower limb 18, as by screws 40. One end of the eccentric shaft 36 is rotatably supported by a bearing 42, preferably an antifriction bearing such as a needle bearing, located on the side of the bracket opposite the device 12, and the other end is supported by the device, which is fixedly attached to the bracket 38 by screws 43 which pass through the bracket 38.

When the compound bow is at rest, as shown in FIG. 1, the eccentric wheels are oriented so that the greater portion of each eccentric wheel is between its own axis and the other eccentric wheel. As the bow is drawn the eccentric wheels rotate in the direction indicated by the arrows 44, and each limb moves with respect to the handle 14 in the direction shown by the arrows 46, until the bow is fully drawn, at which time the eccentric wheel has rotated through approximately three-quarters of a revolution from its original position. During this rotation the eccentric wheels first rapidly increase the force required to pull the bowstring, and later reduce the force, so that a maximum draw force occurs near the point of 180 degrees of rotation.

Because of the rapid increase in force required during the first part of the draw of the compound bow, it is more difficult to hold a compound bow in a partially drawn condition by manually maintaining tension against the bowstring than it is to hold a conventional bow in a similar partially drawn condition. The automatic ratchet device of the present invention, however, allows a bowhunter to relax by preventing more than a slight rotation of the eccentric wheel 30 in the direction opposite to that shown by the arrows 44, so long as the eccentric wheel has not rotated a great distance beyond the point of peak pull. Since the cables are affixed to the eccentric wheels, preventing slippage of each cable with respect to the eccentric wheel, the ratchet holds the bow in its partially drawn position, allowing the hunter to relax his draw slightly until the ratchet device of the present invention assumes the tension of the bent bow. The hunter is then able to remain nearly motionless, even with a partially drawn bow, without becoming overtired by maintaining tension on the bow while waiting for the proper moment to complete the draw and release the bowstring.

Figure 2:
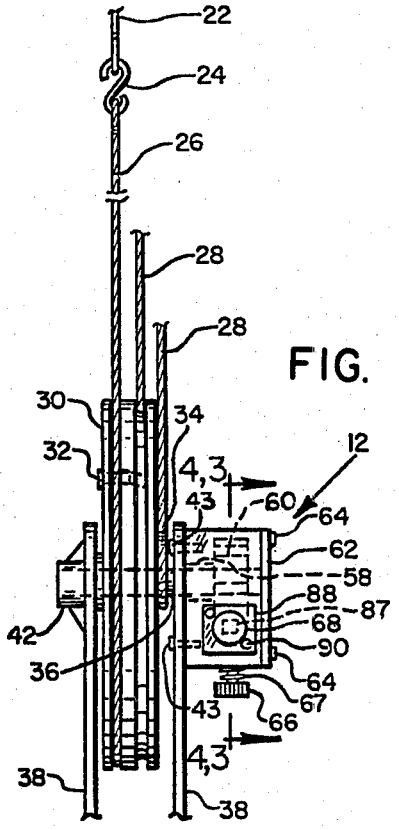
FIG. 2 is a fragmentary view of one of the devices embodying the invention shown in FIG. 1, taken along line 2—2 of FIG. 1.

Referring now to FIG. 2, the device of the invention may be seen in a view taken along the lower limb 18. The device comprises a housing 56, including a cavity 57, which may be made from any suitable material, such as, for example, a block of aluminum. A bearing 58 within the housing 56 cooperates with the bearing 42 on the opposite side of the bracket 38 in supporting the eccentric shaft 36, and the shaft continues beyond the bearing 58 into the cavity 57, where a ratchet wheel 60 is fixedly attached to the shaft. A removable cover plate 62, suitably attached to the housing, as by screws 64, provides access to the cavity 57 for maintenance and allows withdrawal of the eccentric shaft and ratchet wheel, once the eccentric wheel is freed from the eccentric shaft. A lock screw 66 extends through one side of the housing 56, and a retainer spring 67 prevents loosening of the lock screw 66. After an arrow has been shot the ratchet may be reset by any known mechanical means, that shown here being a pawl latch knob 68 which may be pulled.

Figure 3:
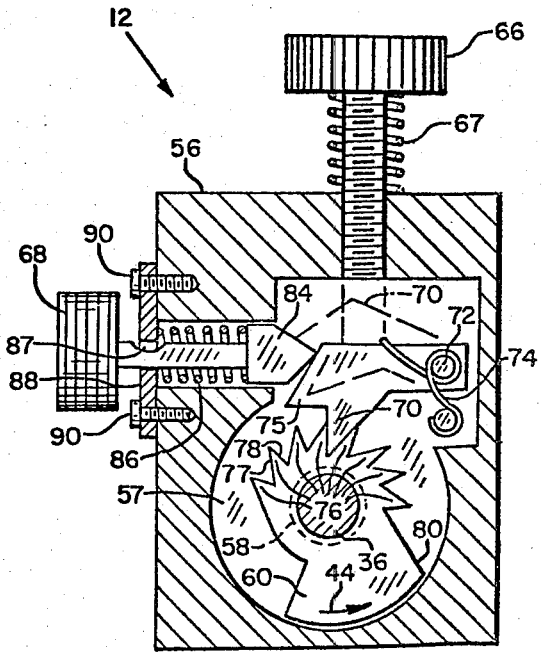
FIG. 3 is a sectional view of one of the devices embodying the invention in in FIG. 1, taken along line 3—3 of FIG. 2.
Figure 4:
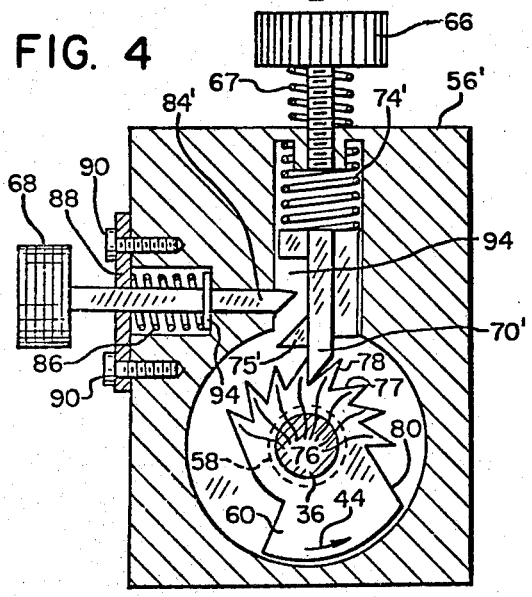
FIG. 4 is a sectional view of another embodiment of the device of the invention, taken along line 4—4 of FIG. 2.

Two preferred embodiments of the internal mechanisms of the device of the present invention are shown in greater detail in FIGS. 3 and 4. In the embodiment shown in FIG. 3, the ratchet wheel, in a position corresponding to a partially drawn bow, is engaged by a pawl 70, which is pivotally mounted upon a pivot pin 72. The pawl is ordinarily held in contact with the ratchet wheel 60 by the elastic bias of a pawl spring 74, although a pawl catch 75 located on the pawl holds the pawl disengaged while an arrow is shot, as will be explained subsequently.

In a preferred embodiment, a number of ratchet teeth 76, each having a sloping front face 77 and a radially-extending rear face 78, are evenly spaced through an arc of about 180° along the edge of the ratchet wheel. A cam 80 is sloped similarly to each front face 77 and extends to a radius great enough to move the pawl 70 clear of the teeth 76.

A pawl latch 84 is reciprocatingly slidable within the housing and is resiliently urged toward the pawl 70 by the biasing force of a pawl latch spring 86. The pawl latch 84 extends through an aperture 87 in a latch cover plate 88, retained by screws 90, which retains the latch spring 86, and the pawl latch knob 68 may be attached to the pawl latch by screw threads.

Another embodiment of the device of the present invention is shown in FIG. 4, where a pawl 70', instead of being pivotally mounted within the housing, is reciprocatingly slidable within the housing. The pawl 70' and the channel 94 in which it slides have a suitable cross section to prevent rotation, maintaining alignment of the pawl to engage the ratchet teeth 76. A helical pawl spring 74' is biased to urge the pawl 70' toward the ratchet wheel 60 to engage the ratchet wheel teeth 76. A pawl latch 84' is similar to the pawl latch 84 of the previously described embodiment, so that when the ratchet wheel 60 rotates to bring the cam 80 into engagement with the pawl 70' the pawl is raised, raising the catch 75' and urging the pawl latch 84' outwardly. When the catch 75' has moved beyond the tip of the latch, the pawl latch 84' is able to move toward its original position, retaining the pawl 70' in a position clear of the ratchet wheel.

The device of the present invention is especially useful while hunting. After the bowhunter has reached a position close enough to a desired animal, he nocks an arrow on the bowstring and begins to draw the string and arrow rearward, thus flexing the limbs of the bow and causing the eccentric wheels 30 to rotate. As the bow is drawn, the pawl 70 within each ratchet device 12 rides sequentially over each of the ratchet teeth 76 of the ratchet wheel 60 as the ratchet wheel is rotated by the rotating eccentric wheel. By slightly relaxing his pull on the bowstring before the bow has approached full draw, the hunter may allow the eccentric wheels 30 to rotate slightly in the direction opposite to that indicated by the arrows 44 in FIG. 1, until the pawl engages one of the ratchet teeth 76, thereby assuming the force exerted by the limbs 16 and 18 of the bow, and allowing the hunter to remain motionless without the effort of opposing the pull of the bow.

As the bow is drawn further, to a point between the peak pull and a fully drawn condition of the bow, the cam 80 of each device engages the pawl 70, lifting the pawl clear of the ratchet teeth 76 and to the position shown in broken line in FIG. 3. As the pawl is forced upward by the cam 80, the catch 75 bears against the end of the pawl latch 84, moving the pawl latch and compressing the pawl latch spring 86 until the catch 75 clears the pawl latch, whereupon the pawl latch spring 86 pushes the pawl latch below the catch 75, overcoming the force of the pawl spring 74, and retaining the pawl in the position shown in broken line.

Once the cam 80 has raised the pawl to its latched position, the ratchet wheel is free to rotate within the cavity 57, allowing the bow to operate as if the automatic ratchet device of the invention were not present while drawing of the bow is completed and the bowstring is released to propel the arrow. Although the general intent is to disable the ratchet mechanism at a point close to but short of the fully drawn condition, the exact point at which the ratchet is disabled is controlled by the angular relationship between the eccentric wheel and the ratchet wheel, and by the rotational position of fastening the housing 56 to the bracket 38, either of which may be adjusted by conventional means such as slots in the bracket 38 through which the screws 43 pass, allowing rotation of the device relative to the bracket. The devices on the two limbs should be aligned so that the pawl latch engages the catch and holds the pawl away from the ratchet before the bow is fully drawn, and for best efficiency the two devices should operate simultaneously so that the force of the flexed limbs is shared by the two cables.

To use the device of the present invention for subsequent shots it is only necessary to withdraw the pawl latch knob 68 of each device far enough to release the pawl and allow the pawl spring 74 to again urge the pawl toward the ratchet wheel.

If the pawl is in a position of engagement with the ratchet wheel, the lock screw 66 may be brought to bear upon the back side 92 of the pawl 70, preventing it from being lifted by the ratchet teeth 76, and thus immobilizing the eccentric wheel 30. With the eccentric wheel thus immobilized, the force required to draw the bow is greatly increased, since the mechanical advantage of the normal operation of the cables around the eccentric wheels is lost, thereby making it extremely difficult to draw the bow.

The device may also be used advantageously when replacing a bowstring, by holding the bow in a partially drawn position in which the bow is flexed, providing slack in the bowstring. With slack thus provided the bowstring may be disengaged from the hooks 24 and a new bowstring may be attached, with much greater ease than with prior art compound bows, which often require special devices to aid in exchanging bowstrings.

It should also be noted that the device of the present invention may be included within the eccentric wheel by appropriate modification of the eccentric wheel. The embodiment herein illustrated, however, may be easily adapted to most, if not all, compound bows, including those in which the eccentric wheels are supported between the sides of a split limb, with only minor modifications of the existing eccentric wheels or fastenings.

The terms and expressions which have been employed in the foregoing abstract and specifications are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. In a compound bow having a pair of flexible limbs and a pair of eccentric wheels, one of said pair of eccentric wheels being associated with each of said limbs, and the axes of rotation of the eccentric wheels being parallel to one another and extending transversely of the direction of flexure of said limbs, a pair of cables, each of said cables having an end and being wrapped around one of said eccentric wheels, attachment means connecting said end of each said cable to a respective end of a bowstring, and means for preventing slippage of each cable relative to the respective eccentric wheel around which it is wrapped, the improvement comprising:

(a) unidirectional motion-limiting and retention means interconnected with one of said eccentric wheels for allowing said one of said eccentric wheels to rotate substantially only in a first direction until it has rotated a predetermined angular distance in said first direction; and (b) release means for deactivating said retention means and allowing free rotation of said one of said eccentric wheels after it has rotated through said predetermined angular distance in said first direction.

2. The device of claim 1 wherein said retention means includes a ratchet.

3. The device of claim 1 including lock means for substantially preventing rotation of said eccentric wheel.

4. The device of claim 1 further comprising reset means for selectively reactivating said retention means once said release means has released said retention means.

5. The device of claim 1 including means for adjusting said predetermined angular distance in said first direction.

6. The device of claim 1 including bracket means for attaching said motion limiting and retention means to a limb of said bow.

7. The bow of claim 1 including one of said unidirectional motion-limiting and retention means associated with each of said eccentric wheels.

8. The bow of claim 1 wherein said predetermined angular distance is no less than the angular distance through which said one of said eccentric wheels rotates as said bow is drawn to a point to peak pull, and no greater than the angular distance through which said one of said eccentric wheels rotates as said bow is fully drawn.

9. In a compound bow having a pair of flexible limbs and a pair of eccentric wheels, one of said pair of eccentric wheels being associated with each of said limbs and the axes of rotation of said eccentric wheels being parallel to one another and extending transversely of the direction of flexure of said limbs, a pair of cables, each of said cables being wrapped around one of said eccentric wheels and having an end, attachment means connecting said end of each of said cables to a respective end of a bowstring, and means for preventing slippage of each cable relative to the respective eccentric wheel around which it is wrapped, the improvement comprising:

(a) unidirectional motion-limiting and retention means interconnected with one of said eccentric wheels for allowing said one of said eccentric wheels to rotate substantially only in a first direction until it has rotated a predetermined angular distance in said first direction; and (b) release means for automatically releasing said retention means and allowing free rotation of said one of said eccentric wheels after it has rotated through said predetermined angular distance in said first direction.

10. The device of claim 9 wherein said retention means comprises a ratchet having a ratchet wheel and a reciprocatingly slidable pawl, and said release means comprises cam means for moving said slidable pawl a predetermined distance and reciprocatingly sliding latch means for thereupon latching said sliding pawl out of engagement with said ratchet wheel.

11. The device of claim 9 wherein said retention means comprises a ratchet having a ratchet wheel and a reciprocatingly rotatable pawl, and said release means comprises cam means for rotating said pawl a predetermined distance and reciprocatingly slidable latch means for thereupon latching said rotatable pawl out of engagement with said ratchet.

* * * * *

UNITED STATES PATENT AND TRADEMARK OFFICE

CERTIFICATE OF CORRECTION

PATENT NO. : 4,294,221

DATED : October 13, 1981

INVENTOR(S) : LeRoy J. Bryant

It is certified that error appears in the above-identified patent and that said Letters Patent are hereby corrected as shown below:

Col. 8, Line 35 Change "reactivating" to --reactuating--.

Col. 8, Line 50 After the word "point" change "to" (2nd. Occurrence) to --of--.

Signed and Sealed this

*Fifteenth* Day of *June 1982*

[SEAL]

*Attest:*

GERALD J. MOSSINGHOFF

*Attesting Officer*

*Commissioner of Patents and Trademarks*